United States Patent [19]

Walberg

[11] 4,153,138

[45] May 8, 1979

[54] LADDER HINGE AND STABILIZER THEREFOR

[75] Inventor: Maynard E. Walberg, Independence, Mo.

[73] Assignee: Allis-Chalmers Corporation, Milwaukee, Wis.

[21] Appl. No.: 837,994

[22] Filed: Sep. 29, 1977

[51] Int. Cl.[2] ..... E06C 5/06; E06C 5/24

[52] U.S. Cl. ..... 182/98; 182/115; 182/129; 280/166

[58] Field of Search ..... 182/91, 97, 98, 86, 182/89, 106, 84, 115, 129; 105/445; 280/166

[56] References Cited

U.S. PATENT DOCUMENTS

| | | | |
|---|---|---|---|
| 2,757,397 | 8/1956 | Valentine | 182/97 |
| 3,997,183 | 12/1976 | Russey | 182/97 |
| 3,999,334 | 12/1976 | Webb | 182/86 |

*Primary Examiner*—Reinaldo P. Machado

*Attorney, Agent, or Firm*—Charles L. Schwab

[57] ABSTRACT

A fold-up ladder is provided for a combine which pivotally connects at its upper end to a deck adjacent an operator's cab at the forward end of the combine. The axis of the pivot connection at the upper end of the ladder substantially coincides with the edge of the deck and the edge of the upper step of the ladder. A gas spring is connected between the deck and the ladder to counterbalance the weight of the ladder as it swings from its lowered position to its overhead transport position. The gas spring has a desirable stabilizing influence on the ladder as it is raised and lowered. When the ladder is moved from its transport position to a lowered position, the line of force of the gas spring passes "overcenter" in relation to the ladder pivot axis thereby permitting the gas spring to releasably hold the ladder in its down position. Appropriate abutments are provided to properly position the ladder in its desired transport and lowered positions.

8 Claims, 4 Drawing Figures

LADDER HINGE AND STABILIZER THEREFOR

BACKGROUND OF THE INVENTION

The operator's cab on an agricultural combine is in an elevated position at the front of the vehicle so as to give the operator a good view of the crop cutting and feeding action of the machine. An access ladder is therefore needed to enable the operator to climb to and from the cab. The ladder is preferably retractable so that its lower end does not drag on corn stalks or the like.

Heretofore, others have provided retractable ladders for mounting and dismounting a combine control station; two such retractable or folding ladders are shown in U.S. Pat. Nos. 3,190,392 and 3,508,627. Additionally, U.S. Pat. Nos. 2,721,345; 3,601,220; 2,757,397; 3,012,633; and 3,869,022 show spring means to assist in raising the ladder in relation to a vehicle or other support.

BRIEF DESCRIPTION OF THE INVENTION

A retractable ladder is provided on a combine which is pivotally connected at its upper end on a horizontal axis for vertical swinging movement from a lowered position, in which an operator can mount the combine from the ground, to an inverted overhead position wherein the ladder is out of the way so as not to interfere with movement of the combine during the threshing operation. The pivot connection, support deck and top step of the ladder are so arranged that the horizontal pivot axis of the pivot connection substantially coincides with the juxtaposed edges of the deck and top ladder step. With this construction, persons using the ladder will not catch the heels of their shoes or boots on the ladder or deck at the junction thereof. Furthermore, the danger of personal injury is minimized since the space between the upper end of the ladder and the deck is so small that people cannot put their fingers or toes therebetween.

Spring means in the form of a gas spring is employed to counterbalance the ladder, thereby assisting the operator in raising the ladder from its lowered position to a transport position. The restraining force of the gas spring is preferably sufficient to hold the ladder in its horizontal position. The position of the gas spring and its pivot connection with the ladder is such that in the lowered position of the ladder the gas spring acts in an overcenter relationship whereby the ladder is restrained in its lowered position by the force of the gas spring.

DETAILED DESCRIPTION OF THE DRAWINGS

Figure 1:
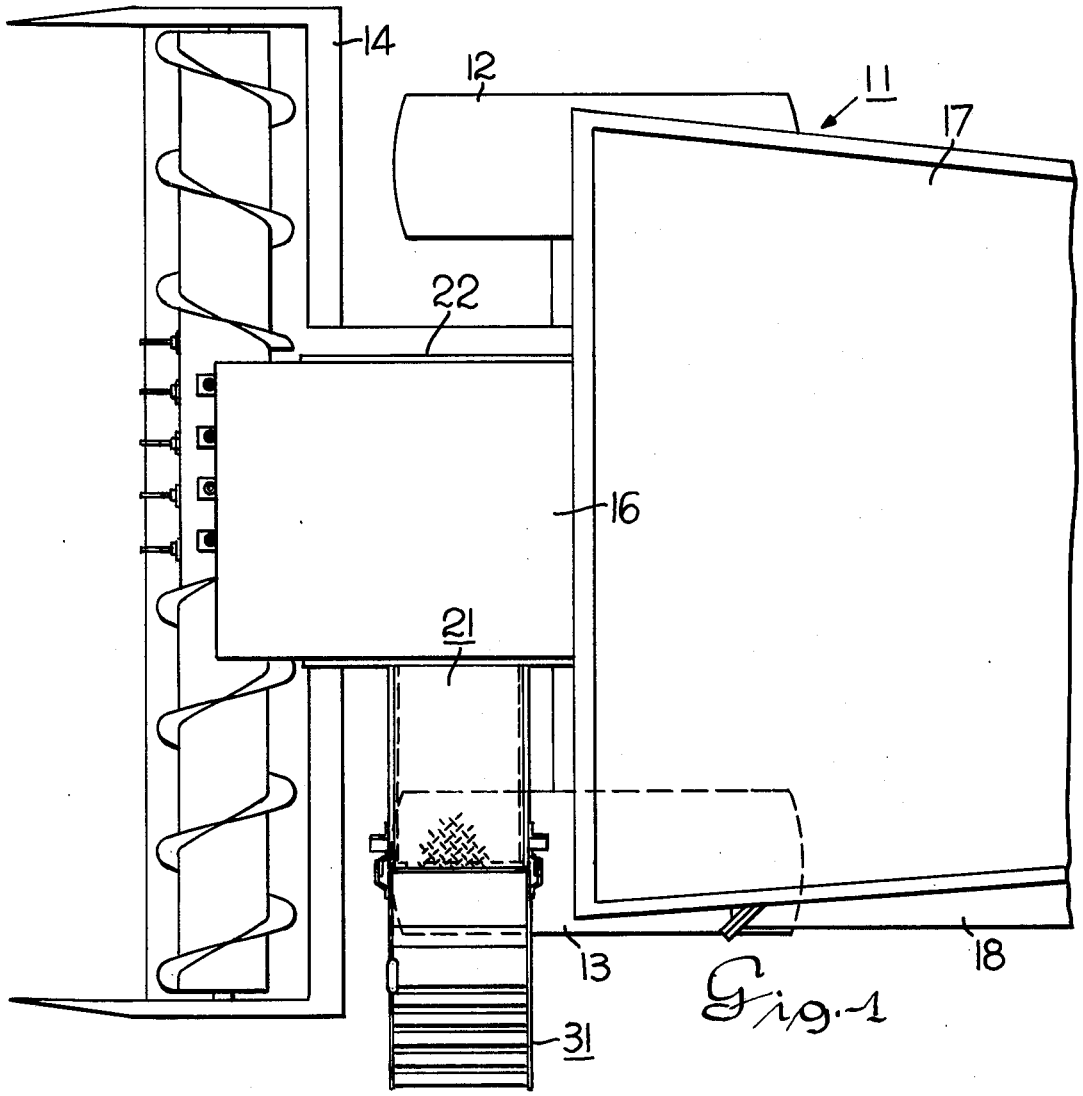
FIG. 1 is a top view of the combine in which the present invention is incorporated.
Figure 2:
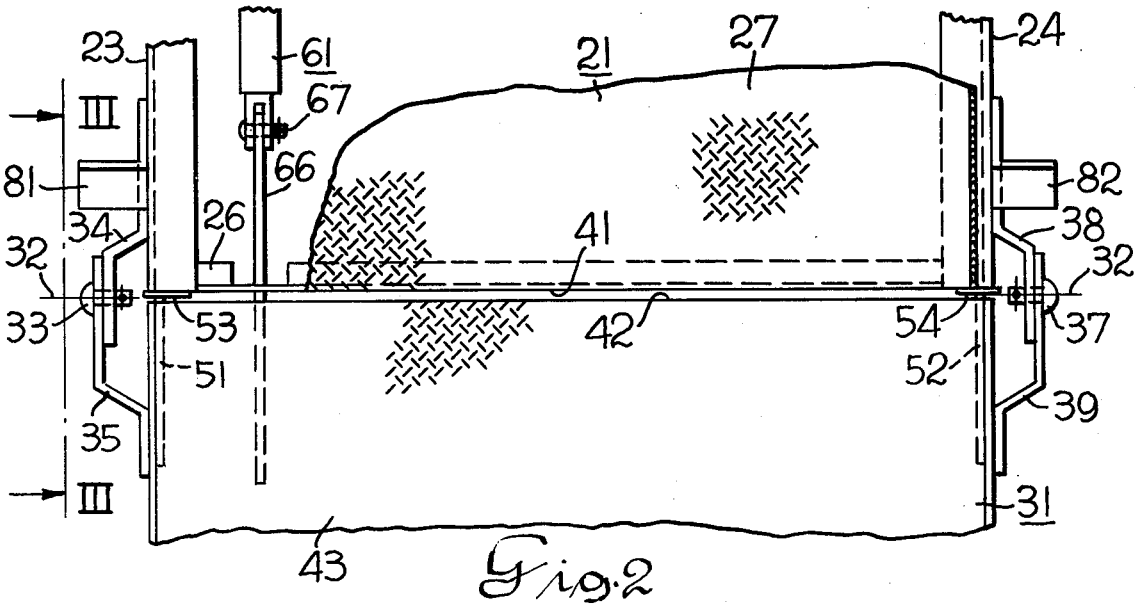
FIG. 2 is an enlarged partial top view showing the upper end of the ladder pivotally connected to the deck adjacent the operator's cab.

Referring to FIG. 1, a combine 11 includes a pair of front drive wheels 12, 13, a front mounted header 14 and rear steerable wheels, not shown. An operator's cab 16 is mounted on a part of the combine frame 22 at the front thereof and in an elevated position generally above the drive wheels 12, 13. A grain bin 17, disposed at the rear of the operator's station 16, is unloaded by means of a swing-out unloading tube 18. A horizontally disposed deck 21 is rigidly secured to the frame 22 and extends laterally outwardly from the operator's cab 16 in overlying relation to the drive wheel 13. Referring also to FIG. 2, the deck 21 includes a pair of parallel laterally outwardly extending channels 23, 24 having their inboard ends secured as by welding to the frame 22. The outer ends of the channels 23, 24 are secured, as by welding, to an angle 26. A deck plate 27 is secured as by welding to the channel members 23, 24 and angle 26. A ladder 31 is pivotally connected to the deck 21 for raising and lowering movement about a horizontal, longitudinal pivot axis 32. The pivotal connection between the ladder 31 and the deck 21 includes a first pivot pin 33 interconnecting a pair of brackets 34, 35 on the deck and ladder, respectively, and a second pivot pin 37 pivotally interconnecting a pair of brackets 38, 39 on the deck and ladder, respectively. The aligned pivot pins 33, 37 are disposed substantially in line with and on opposite ends of the edges 41, 42 of the deck and ladder step 43, whereby the edges 41, 42 stay in close juxtaposed relation as the ladder is swung vertically about the pivot axis 32 between its lowered position shown in FIG. 3 to its transport position shown in FIG. 4. The pivot axis 32 is disposed above the wheel 13 and is spaced laterally inwardly relative to the laterally outer side of the wheel 13 so that when the ladder 31 is raised to its inverted transport position, as shown in FIG. 4, no part of the ladder 31 or its raising mechanism (gas spring 61, bracket 66) extend laterally outward beyond the laterally outer side of the wheel 13.

Figure 3:
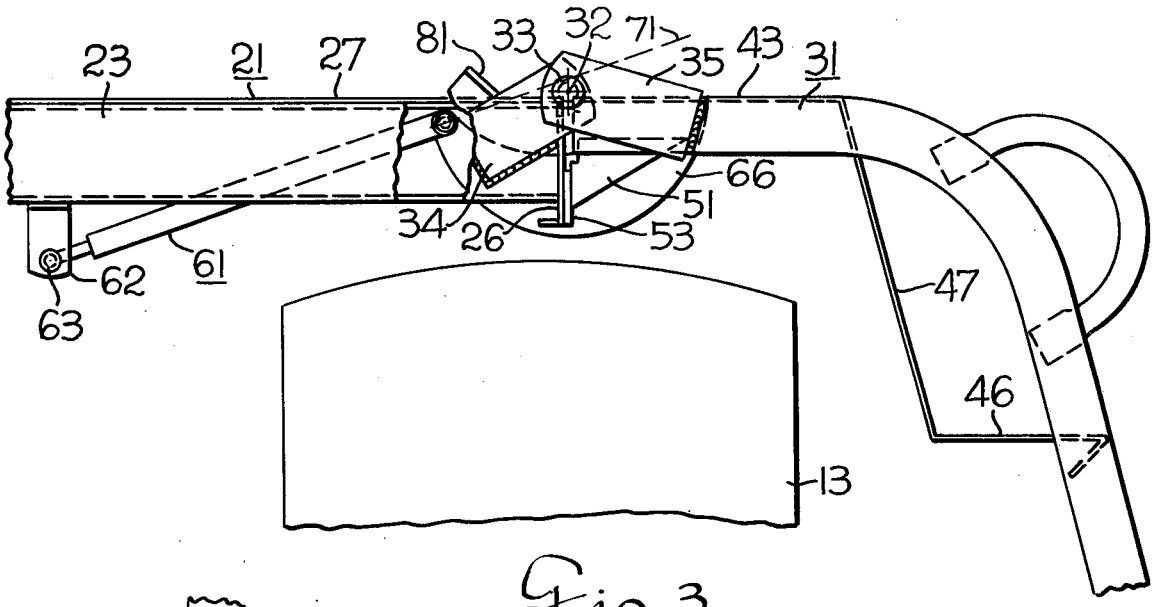
FIG. 3 is a section view taken along the lines III—III in FIG. 2 showing the ladder in its lowered position.

Referring to FIG. 3, it will be noted that the upper surfaces of the deck plate 27 and the upper surface of the top step 43 are coplanar and that the pivot axis 32 is parallel to and closely adjacent to the edges 41, 42. The top step 43 is joined to the next lower step 46 by a generally vertically disposed plate segment 47. As illustrated, the steps 43 and 46 and the plate 47 are a single bent piece of plate material. In the lowered position, as illustrated in FIGS. 2 and 3, abutments in the form of brackets 51, 52 are secured as by welding to the ladder 31 and are in abutting relation to vertically disposed abutments in the form of plates 53, 54 which are secured, as by welding, to the angle 26. In the raised position of the ladder 31, as shown in FIG. 4, the brackets 35, 39 serve as abutments and bear against stops or abutments 81, 82 secured, as by welding, to the deck 21.

Figure 4:
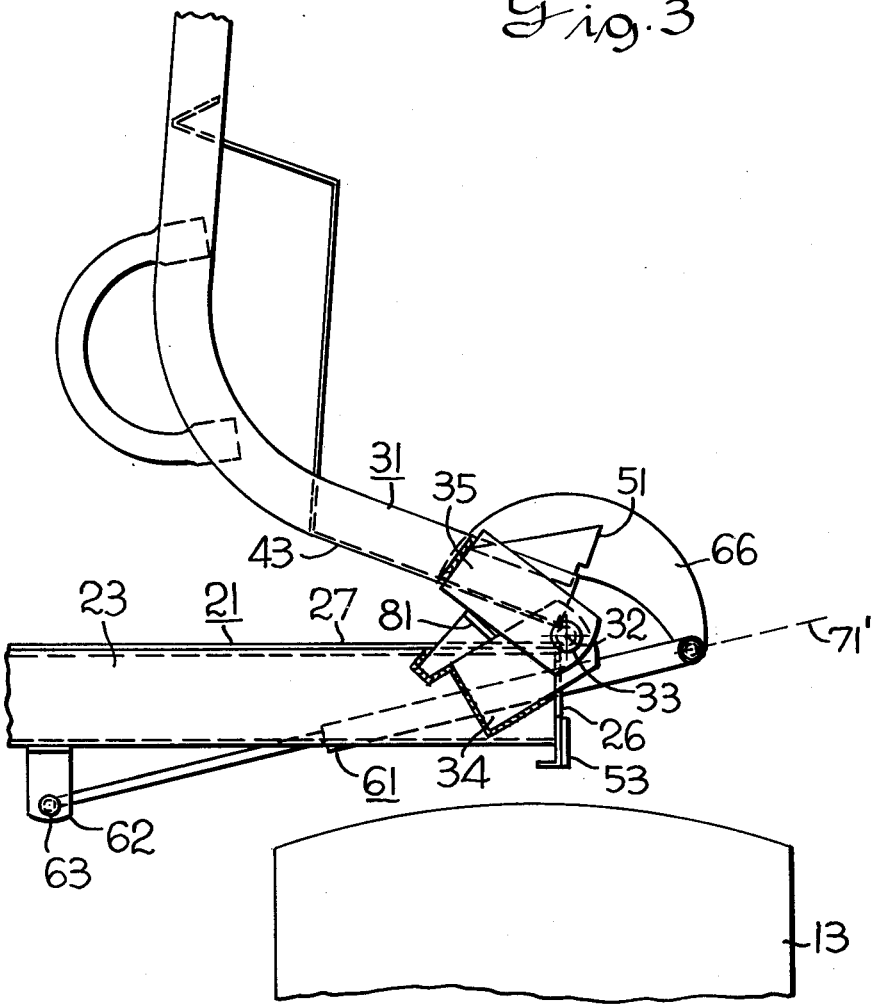
FIG. 4 is a view similar to FIG. 3 but showing the ladder in its raised position.

As shown in FIGS. 2, 3 and 4, a linear acting gas spring 61 has its inboard end pivotally connected to a bracket 62 on the underside of the deck 21 by a pivot pin 63. The outboard end of the gas spring 61 is pivotally connected by a pivot pin 67 to an arm 66 secured as by welding to the underside of the top step 43. The gas spring 61 is disposed beneath the deck 21 in transverse relation to the combine to act in a plane at right angles to the pivot axis 32. As is well known in the art, a gas spring is a linear actuator or counterbalance device which includes a piston and a piston rod in a hermetically closed cylinder. The cylinder is loaded with an inert gas at a selected pressure. An orifice in the piston permits gas to transfer from one side to the other. Since the rod side of the piston has a smaller effective area, the gas tends to push the rod outward.

In the lowered position of the ladder 31, as shown in FIG. 3, the gas spring 61 exerts force in the direction of broken line 71 which passes above the pivot axis 32. Accordingly, in the lowered position of the ladder 31, the gas spring 61 urges the ladder toward its lowered position wherein the abutments 51, 52 contact the abutments 53, 54. In other words, when the gas spring 61 is in the overcenter position of FIG. 3, it restrains the ladder in its illustrated lowered position. The gas spring is sized and pressurized to exert sufficient force to counterbalance the ladder in its generally horizontal position which is intermediate the positions shown in FIGS. 3 and 4. The generally horizontal position of the ladder is the position at which the ladder exerts the greatest amount of force against the gas spring 61. When the ladder is raised to its transport position shown in FIG. 4, the gas spring 61 will exert sufficient restraining force to maintain the ladder 31 in such position. As illustrated in FIG. 4, the force of the gas spring 61 is exerted along the broken line 71' which lies below the pivot axis 32. In this raised, transport position of the ladder 31, the brackets 35, 39 abut against the pair of stops 81, 82 welded to the deck 21.

In the lowered position of the ladder as shown in FIG. 3, the upper step 43 becomes a substantially flat continuation of the deck plate 27 of the deck 21 and the space between the edges of the step 43 and the plate 27 is so small that the heel of a man's shoe or boot cannot become wedged or caught therebetween. Further, it is preferred that the spacing between the edges 41, 42 be sufficiently close so as to prevent a person's finger or toe from being placed therebetween. For this purpose, I prefer that the edges 41, 42 be spaced apart no greater distance than about 5 millimeters. Further, I prefer that the pivot axis 32 be coplanar with or no higher above the upper surface of the step 43 and the top of the deck plate 27 than about 2.5 millimeters.

From the foregoing description it is clear that I have provided a retractable ladder for a combine which may be conveniently raised and lowered without the likelihood of personal injury. The gas spring is pressurized to a sufficient pressure to substantially counterbalance the ladder during raising thereof and, as hereinbefore described, it acts to restrain the ladder in both its lowered and transport positions.

The embodiments of the invention in which an exclusive property or privilege is claimed are defined as follows:

1. In a vehicle having a frame supporting an elevated operator's station and presenting a horizontal deck at one side of said station, the combination comprising:

a ladder having its upper end pivotally connected to said deck for up and down swinging movement about a horizontal axis between a lowered position and a raised, inverted transport position and a linear gas spring mechanism operatively interposed between said frame and said ladder for applying force in a plane transverse to said axis, the line of force applied to said ladder by said gas spring mechanism passing above said axis when said ladder is in its lowered position and passing below said axis when said ladder is in its inverted transport position, said gas spring mechanism being disposed beneath said deck.

2. The combination of claim 1 wherein said gas spring mechanism substantially counterbalances said ladder when it is pivoted to a generally horizontal position.

3. The combination of claim 1 wherein said gas spring mechanism is operative to restrain said ladder in its raised position when the latter is moved thereto.

4. The combination of claim 1 wherein said deck and ladder present juxtaposed horizontal edges closely adjacent to said horizontal axis.

5. In a harvester having an elevated operator's station with a horizontal deck adjacent one lateral side thereof, the combination comprising:

a longitudinal edge on said deck, a ladder pivotally connected to said deck on a longitudinal axis adjacent to said edge and presenting an edge adjacent to said axis, said ladder being vertically swingable about said axis between a lowered position affording access to the operator's station and a raised transport position wherein said ladder is in an inverted position, and a gas spring mounted on said combine beneath said deck and connected to said ladder at a point spaced from said axis whereby in the lowered position said spring urges said ladder in the direction of rotation about said axis toward said lowered position and whereby said spring urges said ladder toward its raised position when said ladder is moved upwardly from its lowered position through a relatively small arc, said point being beneath said deck when said ladder is in its lowered position.

6. The combination of claim 5 wherein said harvester includes a wheel disposed at said one lateral side of said operator's station and below said deck and wherein said longitudinal axis is disposed above said wheel and is spaced laterally inward of the laterally outer side of said wheel, whereby in the raised transport position no part of said ladder or said spring means extends laterally beyond said laterally outer side of said wheel.

7. The combination of claim 5 wherein said ladder includes a top step which presents said edge of said ladder.

8. The combination of claim 7 wherein the upper surfaces of said deck and top step lie substantially in a common plane and said edges lie in said common plane.

* * * * *